US007611666B2

(12) United States Patent
Cercone

(10) Patent No.: US 7,611,666 B2
(45) Date of Patent: Nov. 3, 2009

(54) TUNDISH DRY VIBRATABLE FORM

(75) Inventor: Teacho Cercone, Rocky River, OH (US)

(73) Assignee: North American Refractories Company, Moon Township, PA (US)

( * ) Notice: Subject to any disclaimer, the term of this patent is extended or adjusted under 35 U.S.C. 154(b) by 0 days.

(21) Appl. No.: 12/027,565

(22) Filed: Feb. 7, 2008

(65) Prior Publication Data

US 2009/0200343 A1 Aug. 13, 2009

(51) Int. Cl.
*C21C 5/44* (2006.01)

(52) U.S. Cl. ..... 266/281; 266/280

(58) Field of Classification Search ..... 266/280, 266/281

See application file for complete search history.

(56) References Cited

U.S. PATENT DOCUMENTS 5,042,823 A * 8/1991 Mackay et al. ..... 277/355
5,284,808 A * 2/1994 Damiano et al. ..... 501/103
5,360,200 A * 11/1994 Kloth et al. ..... 266/44
6,280,664 B1 * 8/2001 Kotyuk ..... 264/30

* cited by examiner

*Primary Examiner*—Scott Kastler
*Assistant Examiner*—Xiaobei Wang
(74) *Attorney, Agent, or Firm*—Kusner & Jaffe

(57) ABSTRACT

A mold dimensioned to be positioned within a refractory-lined tundish. The mold has an upper wall and a side wall extending downwardly from the upper wall, the side wall having a shape generally conforming to the shape of the internal cavity of the tundish and having a lower end formed to rest on the refractory lining on the bottom wall of the refractory-lined tundish. The upper wall and side wall define an interior chamber. The side wall of the mold and the refractory lining on the sloping wall of the tundish form a gap therebetween. The gap extends around the mold, the mold being dimensioned such that the gap between the side wall of the mold and the refractory lining on the side wall of the tundish is wider at an upper portion of the internal cavity than at a lower portion of the cavity. A heating means extends through the upper wall of the mold for heating the interior chamber of the mold.

5 Claims, 10 Drawing Sheets

TUNDISH DRY VIBRATABLE FORM

FIELD OF THE INVENTION

The present invention relates to refractory linings for metallurgical vessels and, more particularly, to a method and apparatus for forming a refractory lining in a steel tundish.

BACKGROUND OF THE INVENTION

A tundish is a holding vessel having one or more nozzles extending from the bottom thereof. The nozzles are used to feed molten metal in a controlled manner into molds, as part of a continuous casting process. A tundish is generally comprised of a metal shell defining a metal-holding cavity. A refractory lining extends along the inner surface of the metal shell. It has been known to form the refractory lining with specific layers of refractory material. In this respect, it has been known to apply a first refractory layer of a refractory spray mix along the inner surface of the metallic shell. A thicker castable layer is then cast over the spray mix. The castable layer is the primary layer that protects the metallic shell from the molten metal in the tundish.

To extend the life of the refractory castable, it is known to form a relatively thin layer of refractory over the castable. This thin layer may be in the form of a dry vibratable refractory that includes a heat-setting binder. This dry refractory material is replaced after each use, i.e., sequence, of the tundish. Typically, the thin, dry refractory material is cured with heat prior to use to complete the hot-surface refractory layer.

The present invention provides a method and device for quickly forming and curing the thin, slag-resistant layer of dry refractory material in a tundish.

SUMMARY OF THE INVENTION

In accordance with a preferred embodiment of the present invention, there is provided a device for forming a hot-face refractory layer on a refractory lining in a refractory-lined tundish for holding molten metal. The tundish has a metal shell with a bottom wall and a sloping side wall that define an internal cavity having a predetermined shape. The tundish further has a lining of refractory material on the metal shell. The device is comprised of a mold dimensioned to be positioned within the refractory-lined tundish. The mold has an upper wall and a side wall extending downwardly from the upper wall. The side wall has a shape generally conforming to the shape of the internal cavity of the tundish and has a lower end formed to rest on the refractory lining on the bottom wall of the refractory-lined tundish. The upper wall and side wall define an interior chamber. The side wall of the mold and the refractory lining on the sloping wall of the tundish form a gap therebetween. The gap extends around the mold. The mold is dimensioned such that the gap between the side wall of the mold and the refractory lining on the side wall of the tundish is wider at an upper portion of the internal cavity than at a lower portion of the cavity. A heating means extends through the upper wall of the mold for heating the interior chamber of the mold.

In accordance with another aspect of the present invention, there is provided a device as described above that accommodates dams or walls within the tundish.

In accordance with another aspect of the present invention, there is provided a tundish comprised of a metal shell having a bottom wall and a side wall sloping outwardly from the bottom wall. The bottom wall and the side wall have inner surfaces defining a cavity. A refractory lining is formed along the inner surfaces of the metal shell. The refractory lining has a cool side disposed against inner surfaces of the bottom wall and the side wall, and a hot-side facing the cavity. A thin, replaceable refractory layer is formed on the hot side of the refractory lining. The refractory layer has a thickness that increases on the side wall from the bottom wall to an upper free end of the side wall.

In accordance with another aspect of the present invention, there is provided a method of forming a replaceable hot-face refractory layer on a refractory lining in a tundish. A method comprising the steps of:

providing a tundish having an insulating refractory lining along the inner surface thereof, the tundish having a generally planar bottom wall and a side wall extending outwardly from the bottom wall, the refractory lining defining an informal cavity;

forming a refractory layer on the refractory lining on the bottom wall of the tundish;

positioning a hollow mold within the tundish on the refractory layer on the bottom wall, the mold having a top wall and a side wall extending downwardly from the top wall, the mold having an opened lower end, the mold being dimensioned to form a gap between the side wall of the mold and the side wall of the refractory-lined tundish wherein the gap between the side of the mold and the side wall of the refractory-lined tundish is wider at an upper portion of the cavity than at a lower portion of the cavity;

inserting a dry, vibratable refractory in the gap between the mold and the side wall of the refractory-lined tundish;

heating the interior of the mold to cure the refractory layer on the bottom wall and to cure the vibratable refractory in the gap; and removing the mold from the tundish.

An advantage of the present invention is a method and apparatus for quickly forming a thin, replaceable, hot-face refractory layer in a metallurgical vessel.

Another advantage of the present invention is a method and apparatus for forming a refractory layer in a tundish, which layer is thicker to improve slag resistance at the area where slag is most likely formed.

Another advantage of the present invention is a mold that can be inserted within a tundish to facilitate forming of a dry refractory layer onto an existing layer of refractory material.

Another advantage of the present invention is a mold as described above that accommodates dams or walls within the tundish.

These and other advantages will become apparent from the following description of a preferred embodiment taken together with the accompanying drawings and the appended claims.

DETAILED DESCRIPTION OF PREFERRED EMBODIMENT

Figure 1:
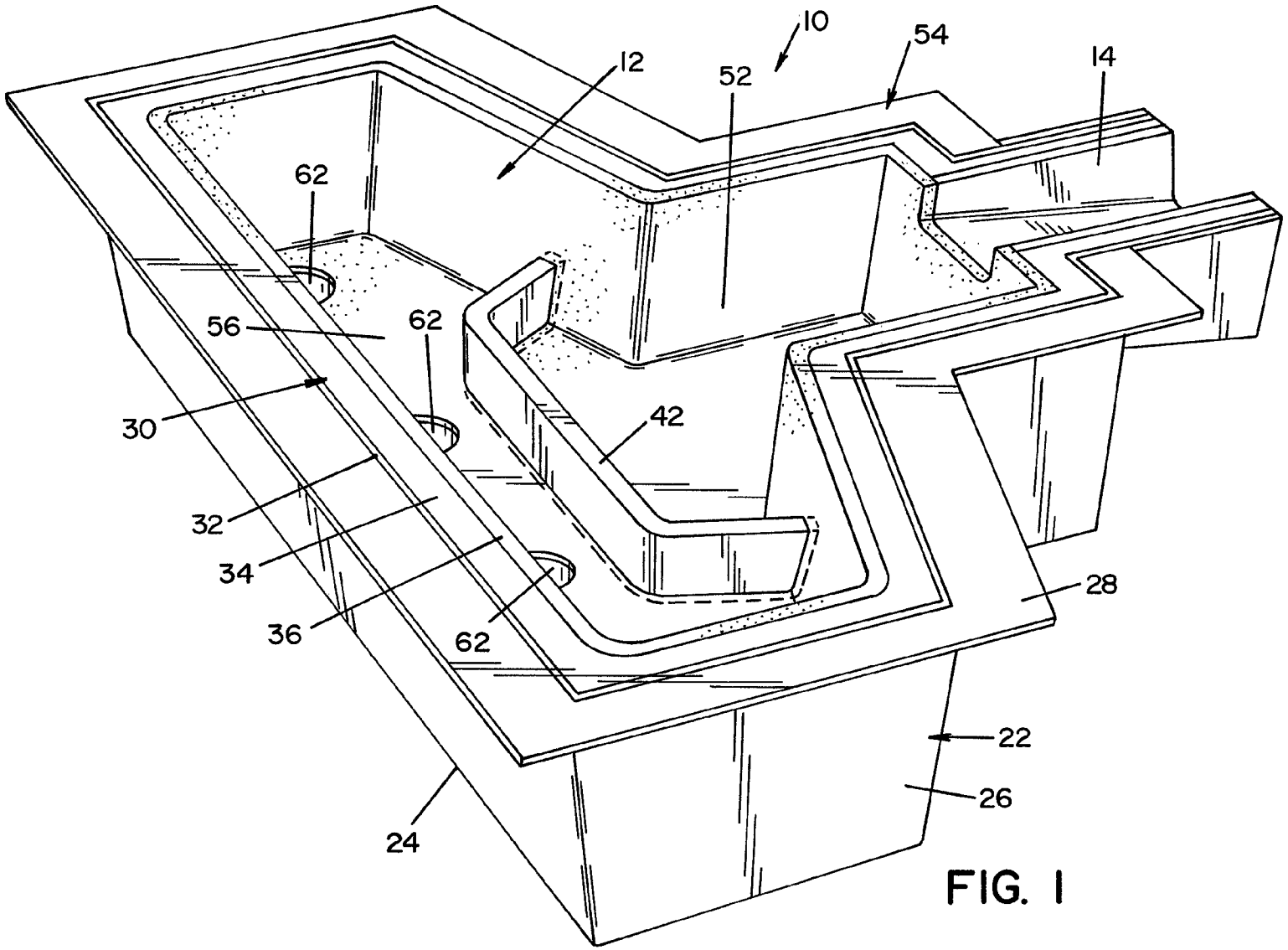
FIG. 1 is a perspective view of a tundish for molten metal, illustrating a refractory lining according to a preferred embodiment of the present invention.
Figure 3:
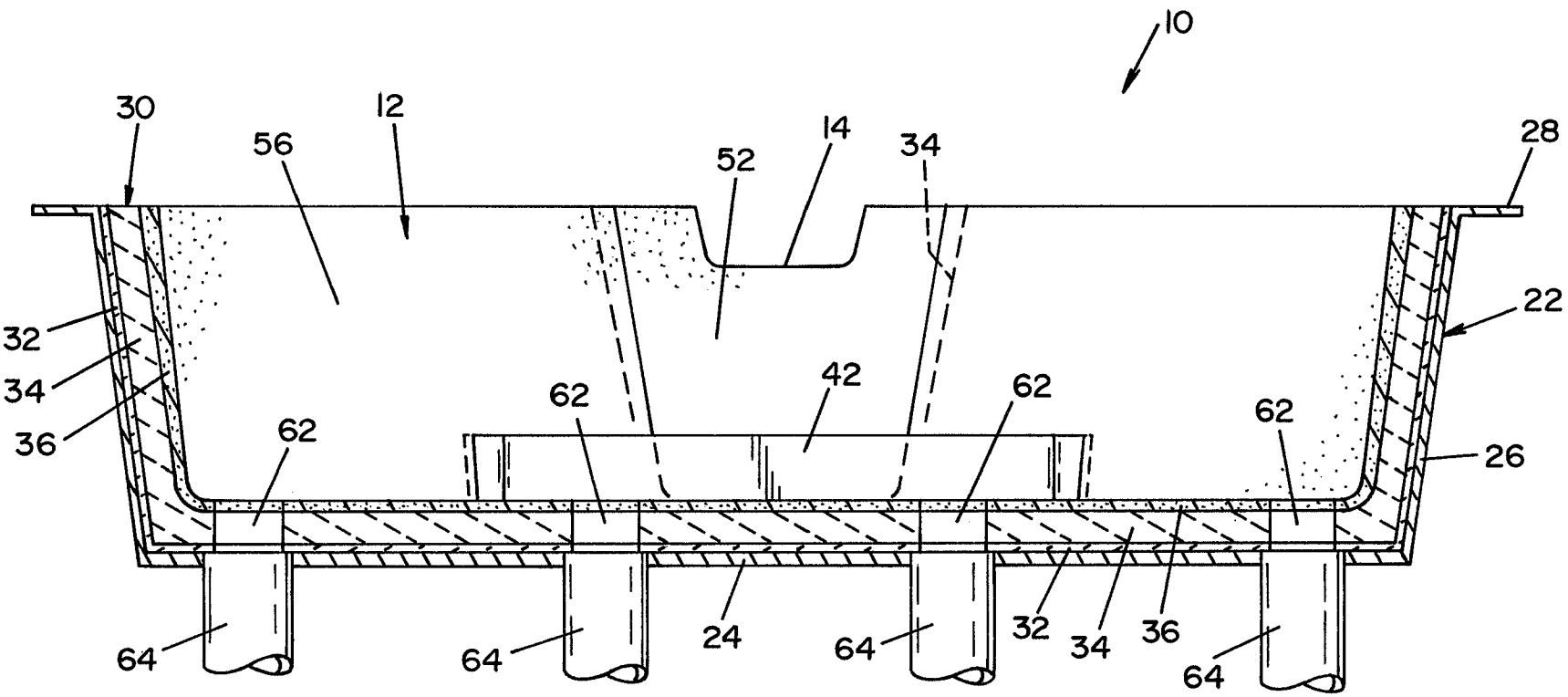
FIG. 3 is a sectional view taken along lines 3-3 of FIG. 2.
Figure 4:
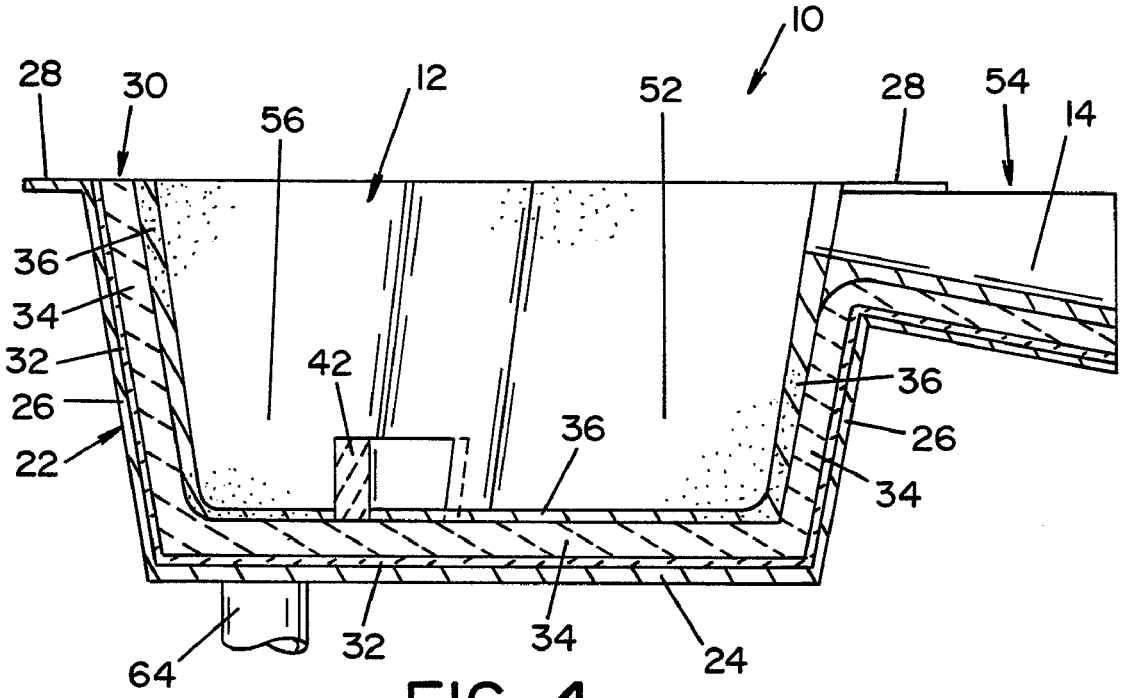
FIG. 4 is a sectional view taken along lines 4-4 of FIG. 2.

Referring now to the drawings wherein the showings are for the purpose of illustrating preferred embodiments of the invention only and not for the purpose of limiting same, FIG. 1 is a perspective view of a tundish 10, illustrating a preferred embodiment of the present invention. Tundish 10 is generally an elongated vessel having an interior cavity 12 and an overflow channel 14 formed to one side thereof. Tundish 10 is comprised of an outer metal shell 22 and an inner refractory lining 30. In the embodiment shown, outer metal shell 22 includes a generally planar bottom wall 24 (see FIG. 3) and a continuous side wall 26 that extends upwardly from the edges of bottom wall 24. As best seen in FIGS. 3 and 4, most of side wall 26 slopes outwardly from bottom wall 24. A flange 28 is formed at the upper edge of side wall 26. Flange 28 projects outwardly from the upper edge of side wall 26 and extends around the periphery of tundish 10, except in the vicinity of overflow channel 14 that extends from tundish 10.

In the embodiment shown, the refractory lining is comprised of three refractory layers designated 32, 34, 36 in the drawings and best seen in FIGS. 3 and 4. First refractory layer 32 is formed along the inner surface of outer metal shell 22. In the embodiment shown, first refractory layer 32 is comprised of a first refractory material. First refractory layer 32 may be formed in a number of different ways, using a number of different refractory materials. In a preferred embodiment, first refractory layer 32 is preferably sprayed on to a surface by a spraying process. Materials such as PNEULITE® SPRAY 22 refractory spray mix finds advantageous application in forming first refractory layer 32. First refractory layer 32 has a thickness of between about three-eighths (⅜) inch (0.953 cm) and about three-quarters (¾) inch (1.9 cm). In one embodiment, first refractory layer 32 has a thickness of about one-half (½) inch (1.27 cm).

Second refractory layer 34 is applied over the surface of first refractory layer 32. Second refractory layer 34 is preferably formed of a cast refractory material. A refractory material, such as, by way of example and not limitation, NARCON® 70 CASTABLE, may be used. Second refractory layer 34 has a thickness of between about three inches (7.62 cm) and nine inches (22.86 cm). In the embodiment shown, second refractory layer 34 has a thickness of about four inches (10.16 cm).

Third refractory layer 36 is applied over second refractory layer 34. Third refractory layer 36 is the innermost refractory layer and comprises a protective layer. In the embodiment shown, third refractory layer 36 is preferably a dry refractory material that can be hardened by curing. In a preferred embodiment, third refractory layer 36 is formed from a dry, vibratable refractory, such as, by way of example and not limitation, NARCOTUN 83 or NARCOTUN 87, manufactured by North American Refractories Company.

In accordance with one aspect of the present invention, third refractory layer 36 is formed such that the thickness of third refractory layer 36 is greater near the upper end of side wall 26, namely in the area where a slag line is most likely to exist, as best seen in FIG. 3. In the embodiment shown, third refractory layer 36 generally increases in thickness as third refractory layer 36 extends upwardly along side wall 26. In other words, third refractory layer 36 is tapered along side wall 26, having a thinner thickness near bottom wall 24 of tundish 10 and a larger thickness at the upper edge of side wall 26. Third refractory layer 36 preferably has a uniform cross-sectional shape about the periphery of tundish 10.

Tundish 10 is dimensioned to receive molten metal. An elongated, precast monolithic dam wall 42 is placed on the bottom of tundish 10, as best seen in FIG. 1. Dam wall 42 is formed to connect with, or be part of, second refractory layer 34. In other words, the distal ends of dam wall 42 connect with second refractory layer 34 on side wall 26, and the lower edge of dam wall 42 connects with the upper surface of the portion of second refractory layer 34 that covers the bottom wall 24 of metal shell 22 of tundish 10. As illustrated in FIG. 1, third refractory layer 36 is formed around the ends and lower edge of dam wall 42.

Dam wall 42 separates the bottom of interior cavity 12 of tundish 10 into a metal-receiving area 52, that includes an extending portion 54 of tundish 10 and a distribution area 56. A plurality of outlet ports 62 is formed to one side of dam wall 42 in the metal-distribution area 56. Typically, outlet ports 62 would be defined by well blocks 63, as illustrated in FIG. 3. A plurality of tundish shrouds 64, best seen in FIG. 3, extends from bottom wall 24 of tundish 10. Openings in shrouds 64 communicate with the drains or outlet ports 62 formed through metal shell 22 and refractory lining 30 to allow chamber 12 within tundish 10 to communicate with the openings in shrouds 64.

Figure 7:
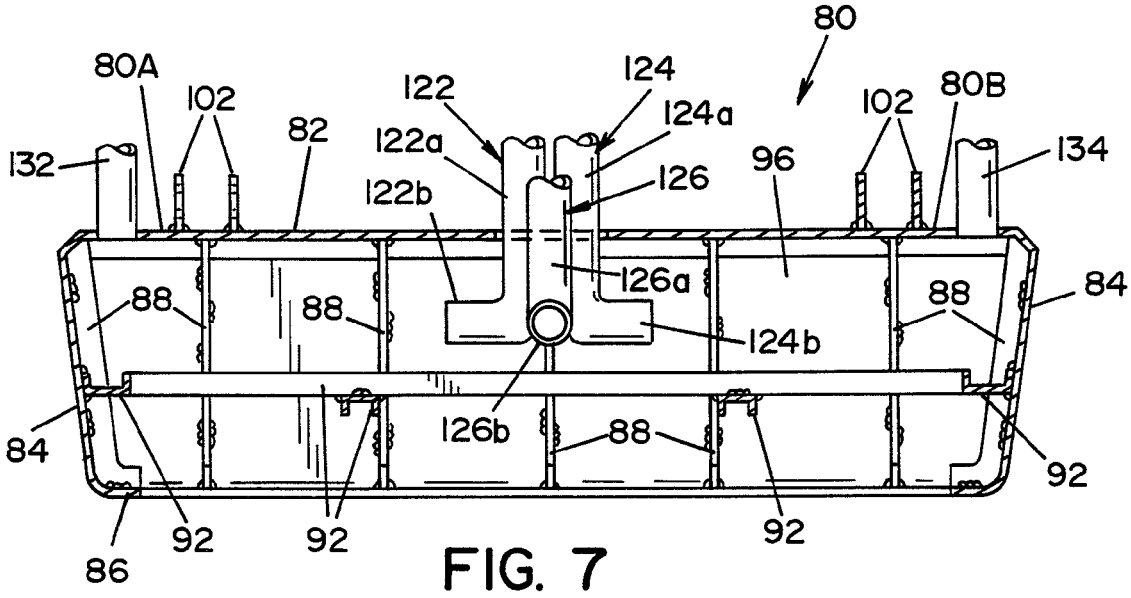
FIG. 7 is a sectional view taken along lines 7-7 of FIG. 5.
Figure 8:
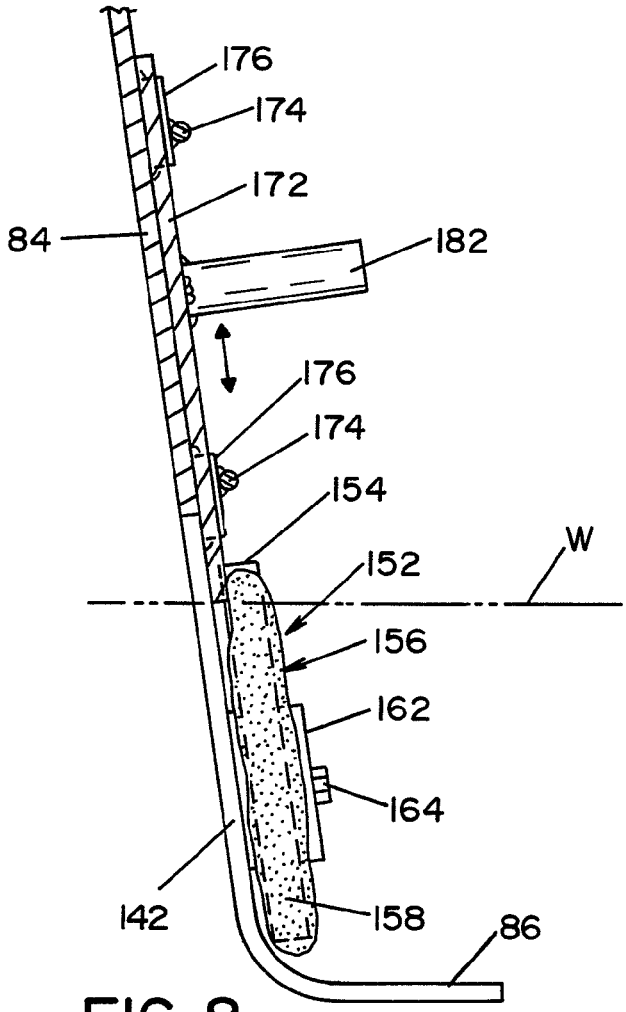
FIG. 8 is a sectional view taken along lines 8-8 of FIG. 5, showing a dam-sealing structure within the mold for sealing the mold around a dam wall within the tundish.

Referring now to FIGS. 5-9, a mold 80 for forming third refractory layer 36 in tundish 10 is shown. Mold 80 includes a top wall 82 and a side wall 84. Side wall 84 extends downwardly from top wall 82. As shall be described in greater detail below, side wall 84 is formed to have a shape that generally conforms to the shape of second refractory layer 34 on the inner surface of tundish 10. Side wall 84 of mold 80 has a lower end that is inturned to form a lip or flange 86 along the bottom of mold 80, as best seen in FIGS. 7 and 8. Vertical ribs 88 and horizontal braces 92 are attached to the inner surface of top wall 82 and side wall 84 to stiffen mold 80 and to maintain the shape thereof. Side wall 84 and top wall 82 of mold 80 define an interior space or cavity 96, best seen in FIG. 10D. Side wall 84 and top wall 82 are preferably formed of a metal material. In one embodiment, side wall 84 and top wall 82 of mold 80 are formed from plate steel, and internal ribs 88 and braces 92 are structural steel members.

Spaced-apart plates 102 are attached to the upper surface of top wall 82. Plates 102 are preferably steel and are attached by welding. Plates 102 are provided as lifting means to facilitate lifting and positioning of mold 80, as shall be described in greater detail below. A pair of plates 102 is disposed at the opposite ends of tundish 10. Plates 102 are spaced apart and have aligned apertures 104 therethrough to receive bolts or threaded rods 106 that are used to attach cables, chains 108, or the like (shown in phantom in FIG. 10D) to mold 80 to lift the same. It is contemplated that other types of lifting elements may be attached to top wall 82 of mold 80, such as, by way of example and not limitation, eye bolts, U-bolts, or bent rods.

Figure 5:
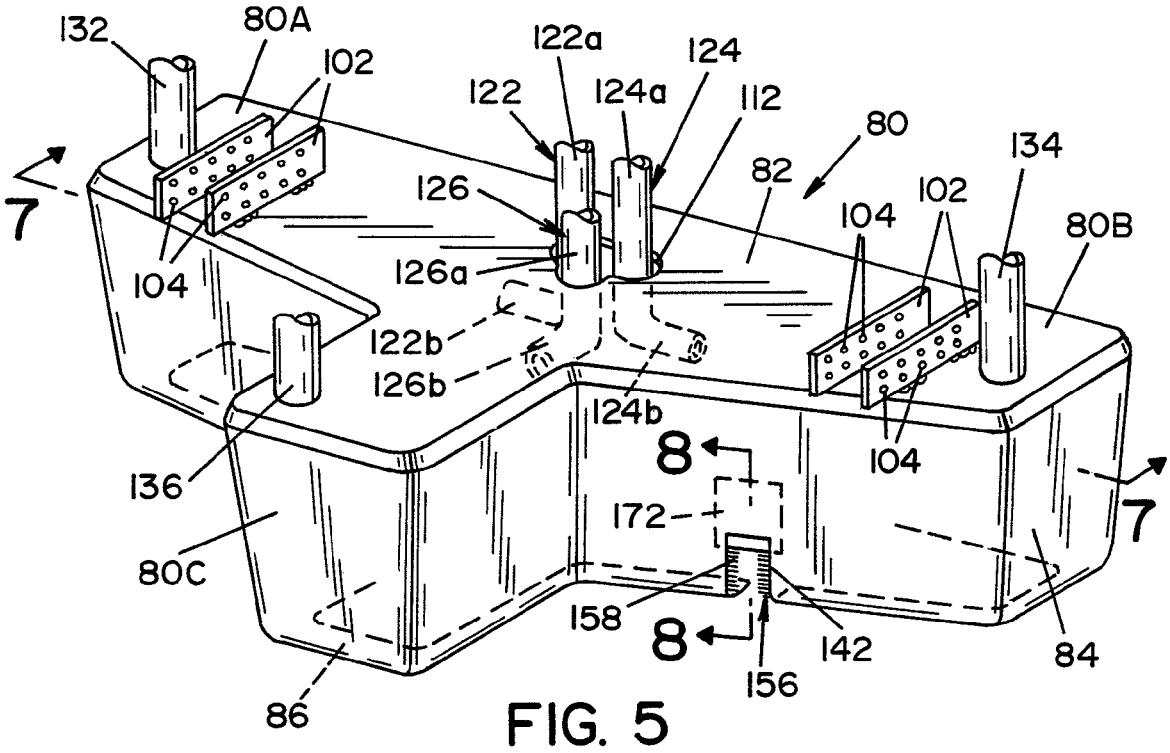
FIG. 5 is a perspective view of a mold (form) for forming the innermost refractory lining shown in FIGS. 1-4.
Figure 6:
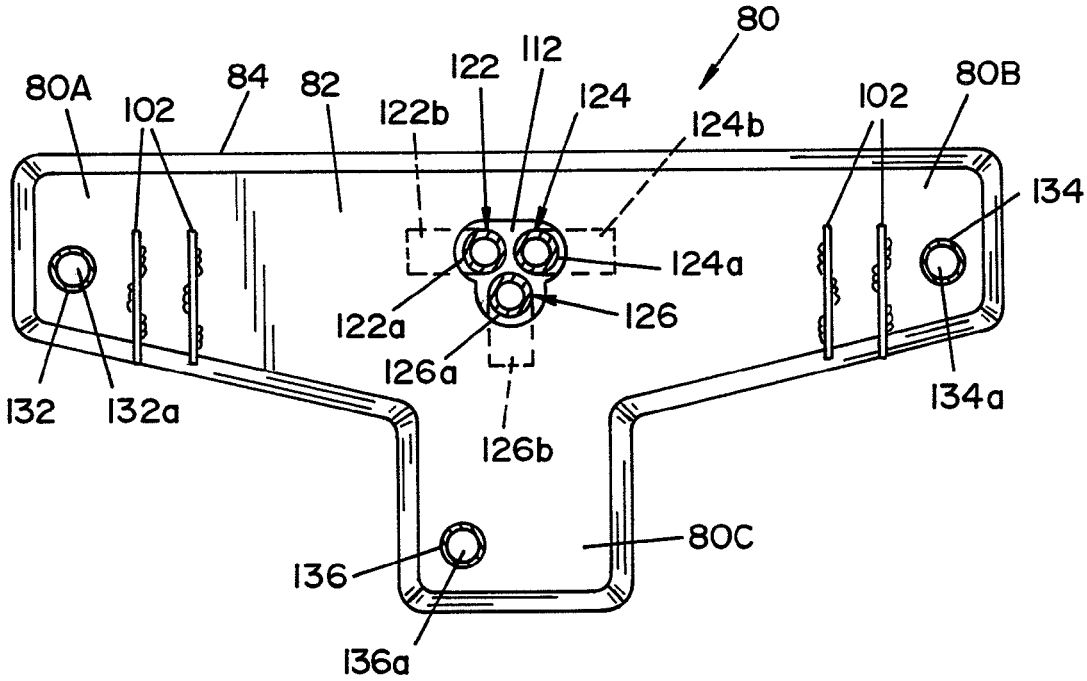
FIG. 6 is a top plan view of the mold shown in FIG. 5.

As best seen in FIG. 5, an aperture 112 is formed in the approximate center of top wall 82 of mold 80. Aperture 112 is shaped and dimensioned to receive heating means comprised of a plurality of inlet pipes, designated 122, 124, 126. Inlet pipes 122, 124, 126 are generally L-shaped, with each pipe having a vertical section 122*a*, 124*a*, 126*a* and a horizontal section 122*b*, 124*b*, 126*b*, respectively, that are directed outwardly into interior space 96 of mold 80. In this respect, mold 80 can be described as having three legs or sections 80A, 80B, 80C. Horizontal section 122*b* of an inlet pipe 122 is directed toward the end of mold section 80A. Horizontal section 124*b* of inlet pipe 124 is directed toward the end of mold section 80B. Horizontal section 126*b* of inlet pipe 126 is directed toward the end of mold section 80C. Inlet pipes 122, 124, 126 are fixedly connected to upper wall 82 by means not shown. Each Inlet pipe 122, 124, 126 is dimensioned to be connected to a source of heat, such as a burner. Inlet pipes 122, 124, 126 are designed to convey heated gas into interior space 96 defined by mold 80, as shall be described in greater detail below. Outlet pipes 132, 134, 136 are attached to top wall 82 of mold 80, at the ends or edges of each section 80A, 80B, 80C, respectively, of mold 80. Outlet pipes 132, 134, 136 have internal passages 132*a*, 134*a*, 136*a*, respectively, that communicate with interior space 96 defined by mold 80.

Figure 9:
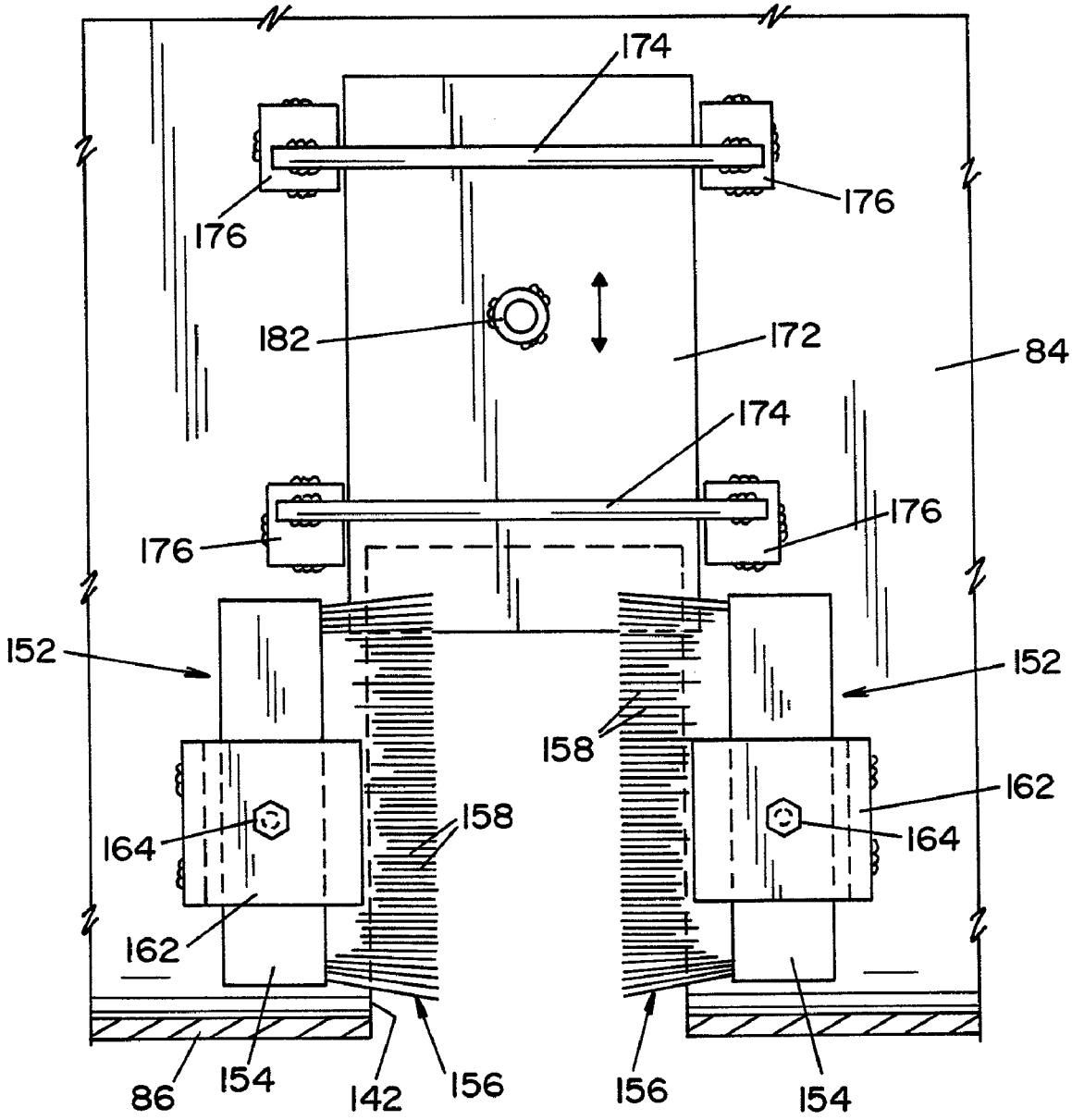
FIG. 9 is an enlarged view of the sealing structure.

Referring now to FIGS. 5, 8, and 9, two vertical slots 142 are formed in side wall 84 of mold sections 80A, 80B. Slot 142 in mold section 80B is shown in FIG. 5. Slots 142 are designed to receive portions of dam wall 42. Slots 142 are shaped to generally conform to the cross-sectional shape of dam wall 42. In the embodiment shown, each slot 142 is generally rectangular in shape. As best seen in FIG. 9, flat, wire brush assemblies 152 are mounted to the inner surface of side wall 84 of mold 80, along the sides of slots 142. The wire brush assemblies 152 include a metal back or spine portion 154 and a metal bristle portion 156 comprised of a plurality of flexible, metal wire elements 158. Wire brush assemblies 152 are mounted such that bristle portion 156 extends into the opening defined by slot 142, as best seen in FIG. 9. In the embodiment shown, an L-shaped clip 162 is welded to the inner surface of side wall 84 of mold 80, such that one leg of clip 162 is parallel to, and spaced from, the inner surface of side wall 84. A space or gap is defined between clip 162 and side wall 84 of mold 80. This space is dimensioned to receive spine or back portion 154 of wire brush assembly 152. A fastener 164 extends through clip 162 to secure the brush assemblies 152 in the positions shown in FIG. 9. As seen in FIG. 9, opposing brush assemblies 152 are disposed on the inner surface of side wall 84, such that wire elements 158 of the brush assemblies 152 extend into slot 142 and reduce the opening defined thereby.

A plate 172 is captured against the inner surface of side wall 84 by two spaced-apart elongated members 174 that extend across plate 172. In the embodiments shown, elongated members 174 are cylindrical rods. The ends of elongated members 174 are secured to pads 176 that are, in turn, secured to the inner surface of side wall 84. Pads 176 are dimensioned to be slightly thicker than plate 172, wherein plate 172 is free to slide up and down along side wall 84 relative to slot 142. The lower end of plate 172 is disposed between bristle portions 156 of brush assemblies 152 and the inner surface of side wall 84. A stop, in the form of a cylindrical pipe 182, extends from the surface of plate 172 to limit motion of plate 172 in the up-and-down direction. Pipe 182 is welded to the surface of plate 172. Pipe 182 engages one or the other of the transversely extending, elongated members 174 to limit motion of plate 172.

The present invention shall now be further described with respect to a method of forming a refractory lining 30 within tundish 10. Refractory lining 30 is formed by applying first refractory layer 32 along the inner surface of metal shell 22. In a preferred embodiment, first refractory layer 32 is sprayed onto metal shell 22 by a spraying process. Once first refractory layer 32 has set, second refractory layer 34 is formed onto first refractory layer 32. In the embodiment heretofore described, second refractory layer 34 is cast in place, using forms.

Figure 2:
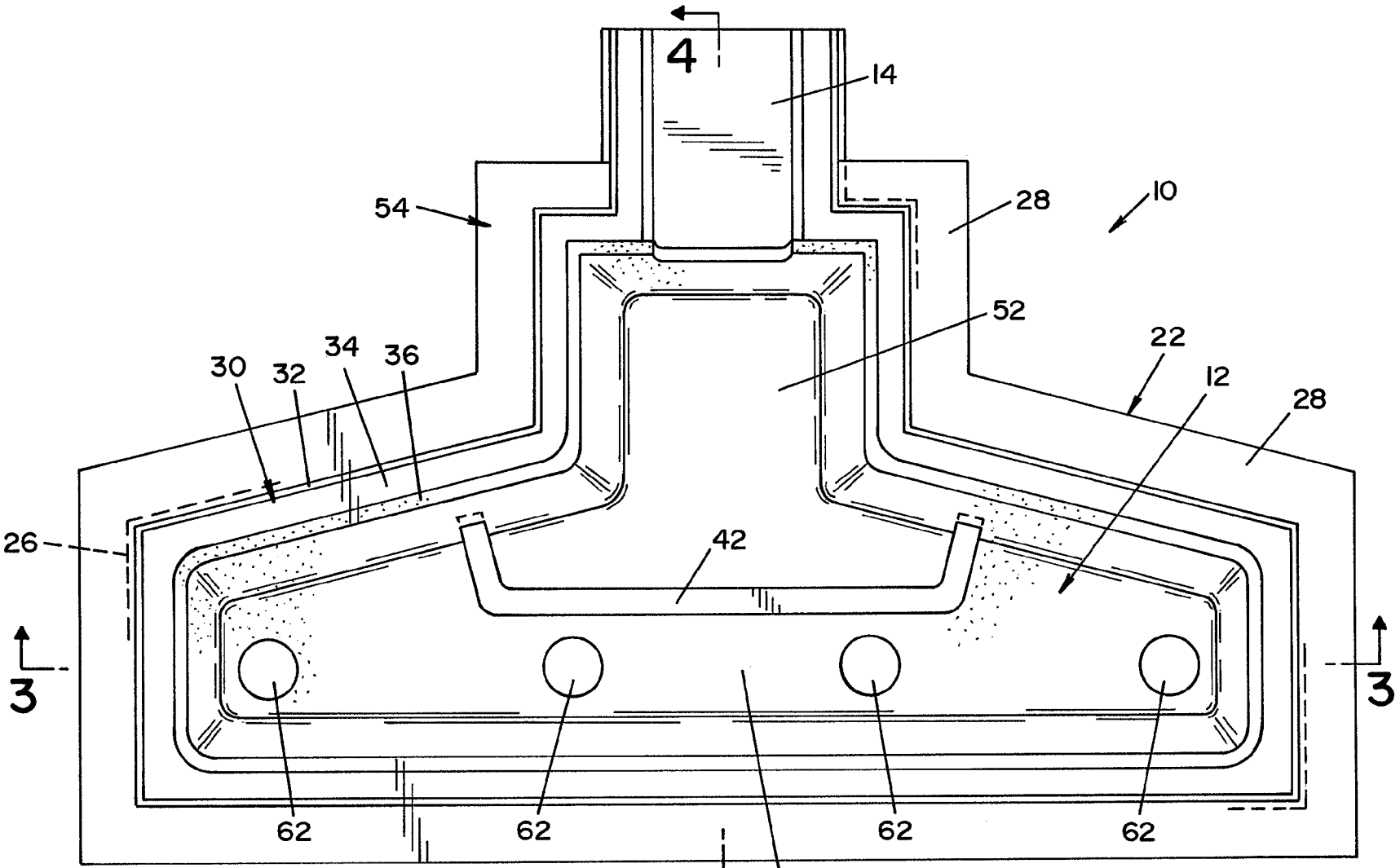
FIG. 2 is a top plan view of the tundish shown in FIG. 1.
Figure 10A:
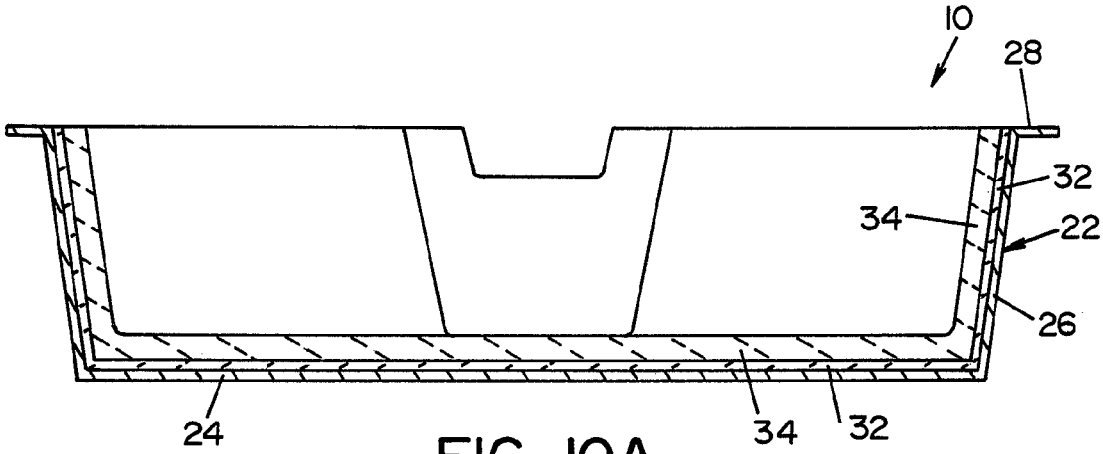
FIGS. 10A-10G are sectional views of a tundish and mold, showing steps in forming the innermost refractory lining.
Figure 10B:
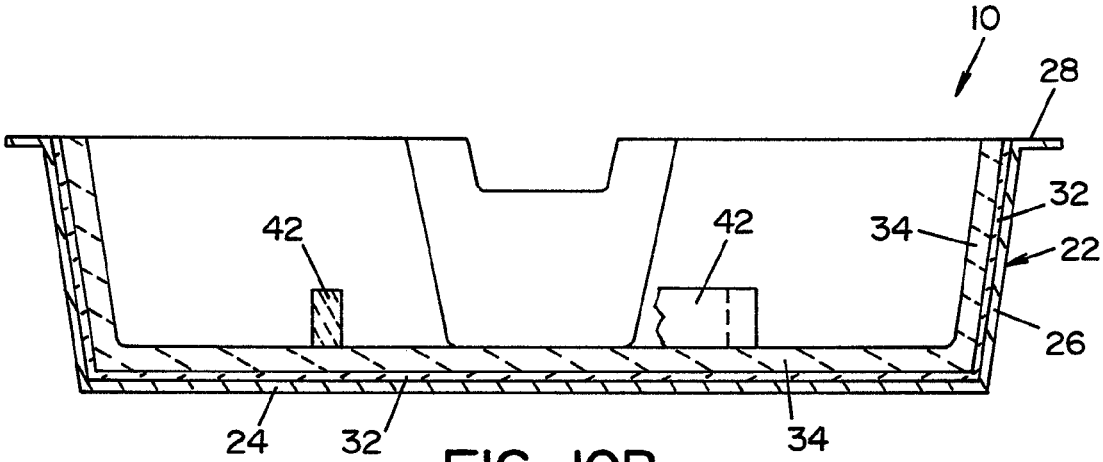

Referring now to FIGS. 10A-10G, a method of forming a third refractory layer 36 in tundish 10 using mold 80 is pictorially illustrated. FIG. 10A shows tundish 10 with first and second refractory layers 32, 34 formed therein. In the drawing shown in FIG. 10A, the thicknesses of the first and second refractory layers 32, 34 are generally uniform, such that the inner surface of second refractory layer 34 generally conforms to the angle defined by side wall 26 of metal shell 22. FIG. 10B shows tundish 10 shown in FIG. 10A with dam wall 42 formed therein. Dam wall 42 is formed of refractory material and extends along the surface of second refractory layer 34. As best seen in FIG. 2, the ends of dam wall 42 communicate with second refractory layer 34 on side wall 26. Dam wall 42 is generally U-shaped when viewed from above and separates metal-receiving area 52 from metal-distribution area 56 of tundish 10.

Figure 10C:
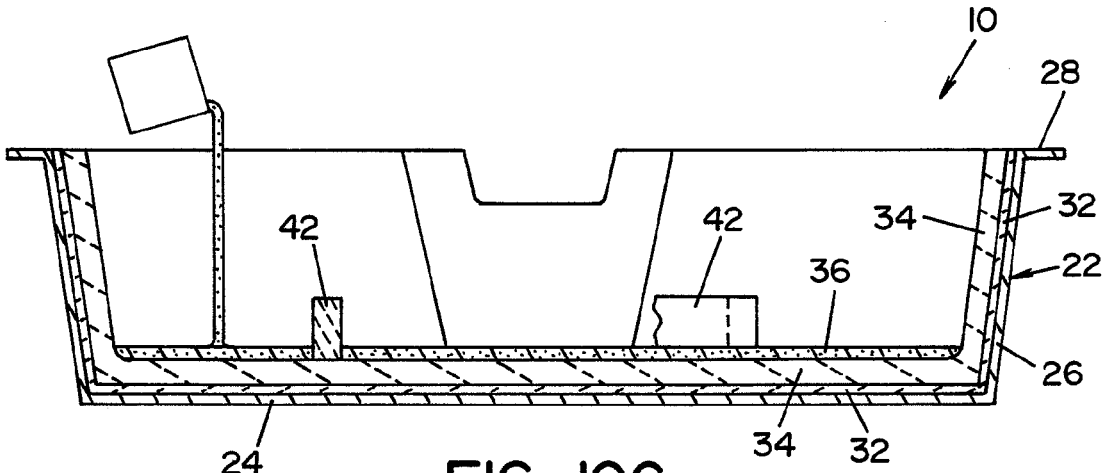

With dam wall 42 in place in tundish 10, the bottom portion of third refractory layer 36 is formed in tundish 10. As indicated above, third refractory layer 36 is preferably formed of a dry vibratable refractory. Accordingly, a uniform thickness of refractory material forming third refractory layer 36 may be formed over second refractory layer 34 in the bottom of tundish 10, as illustrated in FIG. 10C. With the bottom portion of third refractory layer 36 in place, spacers 192 (best seen in FIG. 10D) are positioned around the periphery of tundish 10. Spacers 192 are used to position mold 80 in tundish 10 and to establish a uniform spacing between mold 80 and the inner surface of second refractory layer 34. As pictorially illustrated in FIG. 10D, a chain or cable 108 (shown in phantom in FIG. 10D) supports mold 10 on a pin or rod 106 extending through mounting plates 102.

Figure 10D:
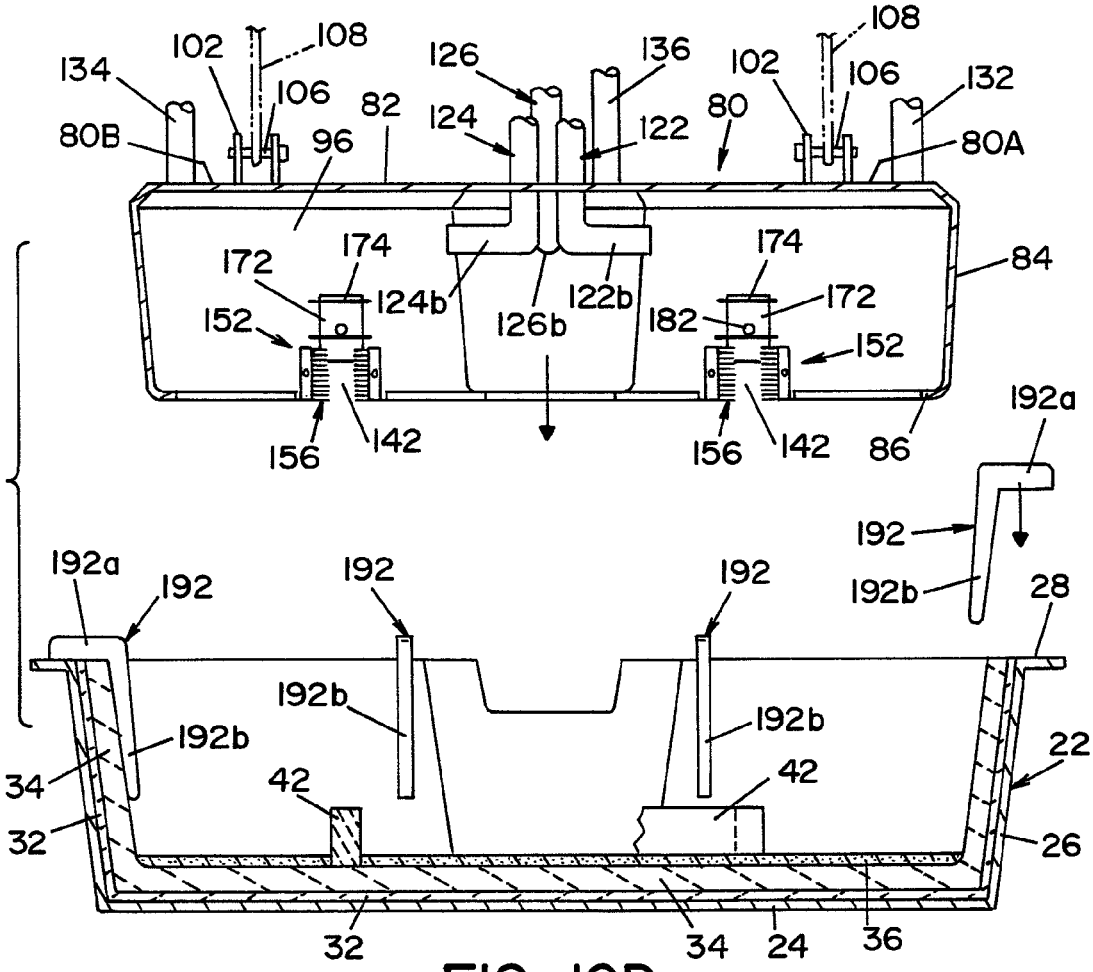

Spacers 192 are generally L-shaped and have a first leg portion 192*a*, dimensioned to rest upon flange 28 and the upper edges of refractory layers 32, 34, and a second leg portion 192*b*, dimensioned to be positioned against the inner surface of second refractory layer 34, as illustrated in FIG. 10D. Leg position 192*b* of spacers 192 define a gap between the outer surface of mold 80 and the inner surface of second refractory layer 34 in tundish 10. With spacers 192 in place, i.e., spaced-apart along the upper edge of tundish 10, mold 80 is lowered into tundish 10. Spacers 192 facilitate positioning mold 80 within tundish 10. In accordance with one aspect of the present invention, side wall 84 of mold 80 is formed to define a gap with second refractory layer 34 of tundish 10, which gap widens from the bottom of tundish 10 as the gap extends to the upper edge of tundish 10. In other words, the gap defined between side wall 84 of mold 80 and second refractory layer 34 in tundish 10 is narrower near the bottom of tundish 10 and wider near the upper edge of tundish 10.

Figure 10E:
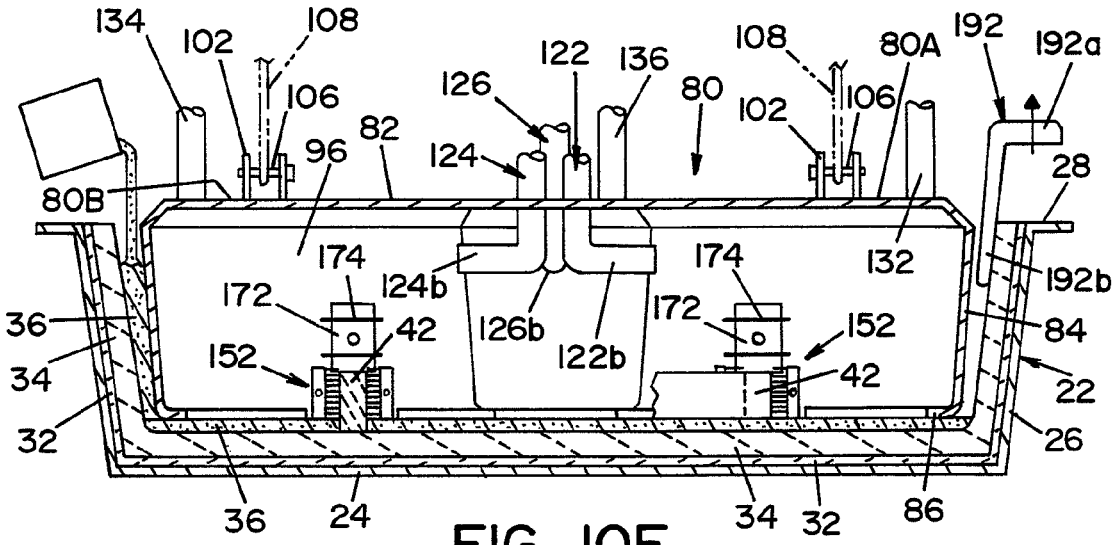

As illustrated in FIG. 10E, slots 142 in side wall 84 of mold 80 are positioned to receive dam wall 42 as mold 80 is lowered into tundish 10. Wire elements 158 of wire brush assembly 152 conform to accept dam wall 42 into slots 142. Because plate 172 within mold 80 is movable up and down when mold 80 is placed within tundish 10, the lower edge of plate 172 will come to rest upon the upper edge of dam wall 42 when mold 80 is in position in tundish 10. FIG. 8 is a cross-sectional view of plate 172 and side wall 84 of mold 80 and illustrates the position of plate 172 when resting on the upper edge of wall 42, which is illustrated by phantom line "W."

As best seen in FIG. 10E, the inturned lower edge, i.e., flange 86, of mold 80 rests upon the previously formed third refractory layer 36. Wire elements 158 engaging the sides of dam wall 42 and plate 172 resting upon the upper surface of dam wall 42 basically form a barrier or seal around dam wall 42. In other words, wire elements 158 of brush assembly 152 and plate 172 close any opening or gap defined between dam wall 42 and slot 142 in the side wall of mold 80.

Figure 10F:
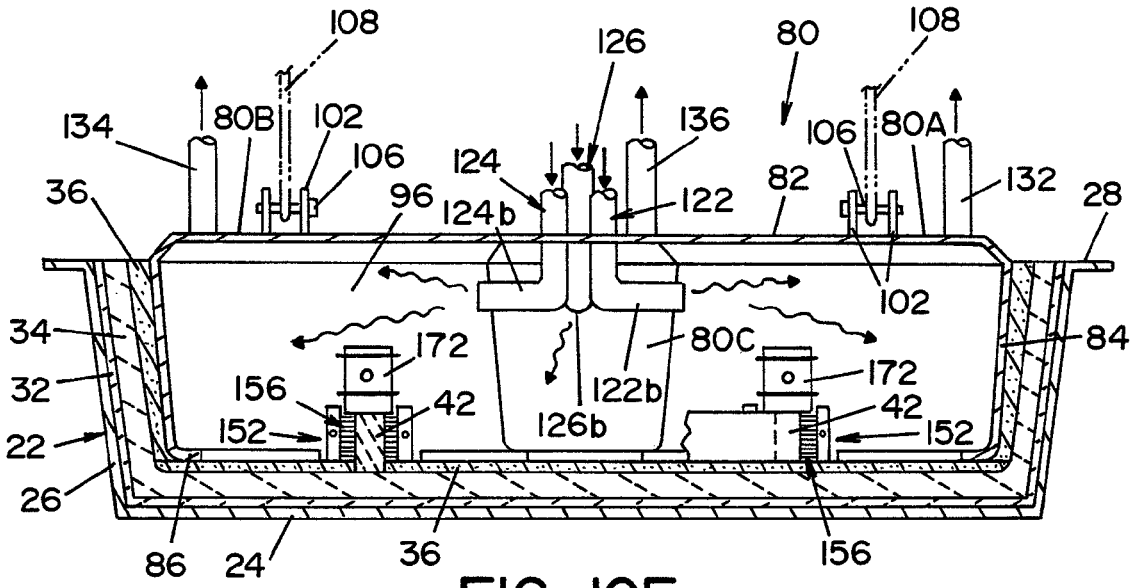

With mold 80 in place within tundish 10, spacers 192 are removed and the dry refractory material used to form third refractory layer 36 is poured into the gap defined between mold 80 and second refractory layer 34 in tundish 10. When the gap surrounding mold 80 is filled with the third refractory material, hot air is blown into interior cavity 96 defined by mold 80, as schematically illustrated in FIG. 10F. In a preferred embodiment, burners and blowers (not shown) are provided to force hot air through inlet pipes 122, 124, and 126 to heat interior cavity 96 of mold 80. Hot gases are vented from mold 80 through outlet pipes 132, 134 and 136, as schematically illustrated in FIG. 10F. The heating of mold 80 essentially cures third refractory layer 36, including the exposed bottom portion of third refractory layer 36. After a predetermined period of time sufficient to cure the vibratory refractory material used to form third refractory layer 36, mold 80 is removed using lifting means 108 discussed above.

Figure 10G:
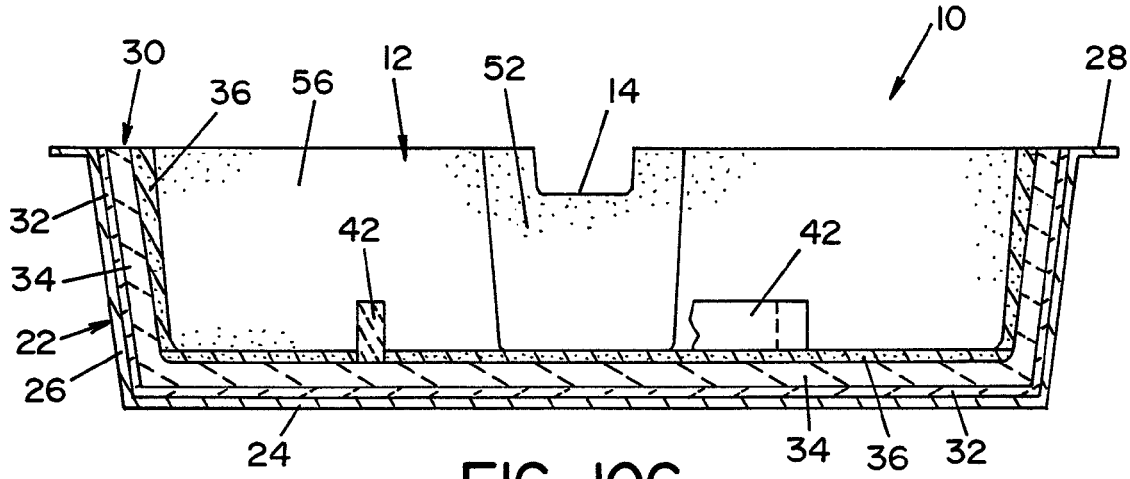

Third refractory layer 36 has cured, thereby producing the resultant refractory lining 30 comprised of first refractory layer 32, second refractory layer 34, and third refractory layer 36. As illustrated in FIG. 10G, third refractory layer 36 is thicker near the upper edge of tundish 10. In this respect, third refractory layer 36 is thicker in the vicinity where a slag line would occur within tundish 10, thereby providing greater thickness of third refractory layer 36 in the area that would experience the most wear as a result of the slag line.

The present invention thus provides a method and apparatus for forming a refractory lining 30 in tundish 10 and, more specifically, a hot-face lining, i.e., third refractory layer 36, having a thicker portion of the lining disposed in the areas most likely to experience wear. By increasing the thickness of the hot-face lining in the high-wear area, such lining is less susceptible to erosion and wear during a run and utilizes less material to form such lining. Moreover, mold 80 according to the present invention provides a quick and efficient means of producing the hot-face lining in tundish 10.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. In a refractory-lined tundish for holding molten metal, said tundish having a metal shell with a bottom wall and a sloping side wall that define an internal cavity having a predetermined shape, and said tundish having a lining of refractory material on said metal shell, a device for forming a hot-face refractory layer on said refractory lining, said device comprised of:

a mold dimensioned to be positioned within said refractory-lined tundish, said mold having an upper wall and a side wall extending downwardly from said upper wall, said side wall having a shape generally conforming to the shape of said internal cavity of said tundish and having a lower end formed to rest on said refractory lining on the bottom wall of said refractory-lined tundish, said upper wall and side wall defining an interior chamber, said side wall of said mold and said refractory lining on said sloping wall of said tundish forming a gap therebetween, said gap extending around said mold, said mold being dimensioned such that said gap between said side wall of said mold and said refractory lining on said side wall of said tundish is wider at an upper portion of said internal cavity than at a lower portion of said cavity, said mold including spaced-apart slots formed in said lower end of said side wall, said slots dimensioned to receive ends of a dam wall disposed in said tundish, said mold also including flexible seal elements disposed along each side of each of said slots to sealingly engage sides of said dam wall when said mold is disposed in said tundish, and a heating means extending through said upper wall of said mold for heating the interior chamber of said mold.

2. A mold as defined in claim 1, wherein said heating means included inlet ports connectable to a source of heated gas, said inlet ports communicating with said interior chamber of said mold to heat said side wall of said mold and the bottom of said tundish.

3. A mold as defined in claim 2, wherein said mold included outlet ports communicating with said interior chamber for venting the heated gas therefrom.

4. A mold as defined in claim 1, wherein a movable plate is disposed at the upper end of each of said slots, said plate having a lower edge dimensioned to engage an upper surface of a dam wall in said tundish when said mold is disposed in a tundish.

5. A mold as defined in claim 1, wherein said flexible seal elements extend into the openings defined by said slots.

* * * * *